US006315623B1

(12) United States Patent
Hedlund

(10) Patent No.: US 6,315,623 B1
(45) Date of Patent: Nov. 13, 2001

(54) DRIVE MEANS IN A BOAT

(75) Inventor: Benny Hedlund, Hono (SE)

(73) Assignee: AB Volvo Pents, Gothenburg (SE)

( * ) Notice: Subject to any disclaimer, the term of this patent is extended or adjusted under 35 U.S.C. 154(b) by 0 days.

(21) Appl. No.: 09/581,922

(22) PCT Filed: Dec. 17, 1998

(86) PCT No.: PCT/SE98/02362

§ 371 Date: Oct. 5, 2000

§ 102(e) Date: Oct. 5, 2000

(87) PCT Pub. No.: WO99/35034

PCT Pub. Date: Jul. 15, 1999

(30) Foreign Application Priority Data

Dec. 19, 1997 (SE) ..... 9704785

(51) Int. Cl.[7] ..... B63H 5/125
(52) U.S. Cl. ..... 440/56; 440/112; 440/65
(58) Field of Search ..... 440/56, 55, 53, 440/65, 112

(56) References Cited

U.S. PATENT DOCUMENTS

| | | | | |
|---|---|---|---|---|
| 1,858,582 | | 5/1932 | Fahrney . | |
| 1,943,288 | | 1/1934 | Chandler et al. . | |
| 2,681,029 | * | 6/1954 | Canazzi | 440/112 |
| 2,917,019 | | 12/1959 | Krueger . | |
| 4,036,163 | * | 7/1977 | Pehrsson | 440/112 |

FOREIGN PATENT DOCUMENTS

| | | |
|---|---|---|
| 35 19 599 | 1/1986 | (DE) . |
| 0 215 758 | 3/1987 | (EP) . |

* cited by examiner

*Primary Examiner*—Sherman Basinger
(74) *Attorney, Agent, or Firm*—Young & Thompson

(57) ABSTRACT

Drive assembly in a boat includes a propeller shaft housing (5) which projects downwards on the underside of the bottom (4) of the boat and is connected to a drive unit (1), arranged on the inside of the boat, via members (9) which, in the event of a load acting on the housing, for example in the event of grounding, bring about controlled separation of the housing from the drive unit and the bottom of the boat.

8 Claims, 2 Drawing Sheets

DRIVE MEANS IN A BOAT

CROSS REFERENCE TO RELATED APPLICATION

This is the 35 USC 371 national stage of international application PCT/SE98/02362, filed on Dec. 17, 1998, which designated the United States of America.

FIELD OF THE INVENTION

The present invention relates to a drive assembly in a boat, comprising a propeller drive which is arranged on the outside of a boat hull and has an at least essentially vertical drive shaft which, via an angle gear enclosed in an underwater housing, drives at least one at least essentially horizontal propeller shaft, and a drive unit which is arranged on the inside of the hull and to which the vertical drive shaft is drivably connected.

BACKGROUND OF THE INVENTION

One type of drive assembly, which is commonly found in sailing boats with a divided lateral plane, consists of an inboard-mounted engine and, coupled drivably thereto, a drive unit which comprises a reversing gear, a drive shaft leg, which extends through an opening in the bottom of the boat, and, designed at a lower end of the drive shaft leg, a housing containing an angle gear and a propeller shaft. Until now, this type of drive assembly has been used virtually exclusively in slow-moving boats such as, for example, the abovementioned sailing boats with a divided lateral plane, where the drive shaft leg with its housing is suspended in a protected manner behind the keel of the boat and thus does not run the risk of being damaged in the event of grounding or running into an object.

It is a known fact that, with an outboard drive coupled to an inboard engine, it is possible to achieve higher overall efficiency than with an inboard engine coupled to a straight shaft in fast motor boats. Until now, however, outboard drives in fast motor boats have been of the type which is pivotably suspended in the flat of the stern of the boat and thus not of the type which has a fixed drive shaft leg which, for example, extends through the bottom of the boat. The advantage of suspending the drive in the flat of the stern is that the drive can be equipped with a safety lock which is released at a given load so that the drive can be tipped up and in this way reduce the damage that would otherwise arise in the event of, for example, grounding, and that it can be trimmed at different angles in relation to the flat of the stern so as to adapt the drive angle to the loading of the boat, the speed of the boat and the weather conditions, so that optimum propulsion can be achieved under different operating conditions. The advantages of being able to trim the drive are most apparent in smaller and medium-sized fast-moving boats, for example of sizes up to about 40 feet. The larger and heavier the boat is, the less its position in the water is affected by said factors and the smaller the need to trim the drive. At the same time, the cost of the drive increases considerably, the greater the power that is to be transmitted. For these reasons, inter alia, outboard drives are seldom used in boats of sizes over 40 feet, but in this case the engines drive straight propeller shafts via inboard-mounted reversing gears. As a result, however, the possibility of reducing the damage in the event of grounding is lost. Violent grounding of a boat with straight propeller shafts therefore has serious consequences in most cases. Shafts and bearing brackets are destroyed and, not infrequently, the engine is pulled loose from its attachments resulting in damage to the engine seatings. In the worst case, the propellers may be pushed up against the bottom of the boat and tear holes resulting in leakage which in the most serious case may lead to the boat sinking.

SUMMARY OF THE INVENTION

The object of the present invention is to provide a drive assembly of the type referred to in the introduction, which is primarily but not exclusively intended for larger fast motor boats in order to make possible higher overall efficiency than with an installation with straight propeller shafts, at the same time as the damage in the event of grounding can be reduced.

According to the invention, this is achieved by virtue of the fact that the drive is connected to the hull of the boat via members which, in the event of a given load acting on the underwater housing in the direction of the propeller shaft, bring about controlled separation of at least the underwater housing from the drive unit and the hull of the boat.

A rigidly mounted drive assembly of this type, which does not have arrangements for tipping and trimming, can be produced at a lower cost than conventional steerable and tippable outboard drives mounted on the flat of the stern and can therefore advantageously replace straight propeller shafts in heavier fast-moving motor boats so as to increase the speed of the boat and/or reduce its fuel consumption at a given speed, at the same time as the damage in the event of grounding can be reduced considerably.

In a preferred embodiment of the drive assembly according to the invention, said members comprise elongate connecting elements which extend through openings in the bottom of the boat and are anchored in the housing and the drive unit. Arranged in the openings are cutting members which, in the event of a given displacement of the housing in the direction of the propeller shaft, cut the connecting elements. As a result, a controlled separation of the housing from the drive unit and the hull of the boat is achieved using simple means.

By means of the embodiment according to the invention, it is also possible to equip larger fast-moving motor boats, that is to say boats in the size class over 40 feet, with twin counter-rotating propellers and, in a preferred embodiment of the drive assembly, two concentric propeller shafts driven in a counter-rotating manner are mounted in the housing and each bear their own propeller.

It is certainly known per se to equip vessels with concentric counter-rotating shafts each with their own propeller just as it is also known to provide fast motor boats with steerable and tippable outboard drives with twin counter-rotating propellers in order to achieve maximum propeller efficiency. On account of, inter alia, the fact that concentric propeller shafts require very close tolerances and that mounting is complicated when the shafts are long in relation to the diameter, twin counter-rotating propellers have nevertheless not been used in fast boats with straight shafts. By virtue of the invention, it is thus possible to derive advantage from twin counter-rotating propellers in larger fast-moving motor boats also.

BRIEF DESCRIPTION OF THE DRAWINGS

The invention is described in greater detail with reference to exemplary embodiments shown in the appended drawing, in which.

DESCRIPTION OF THE PREFERRED EMBODIMENTS

Figure 1:
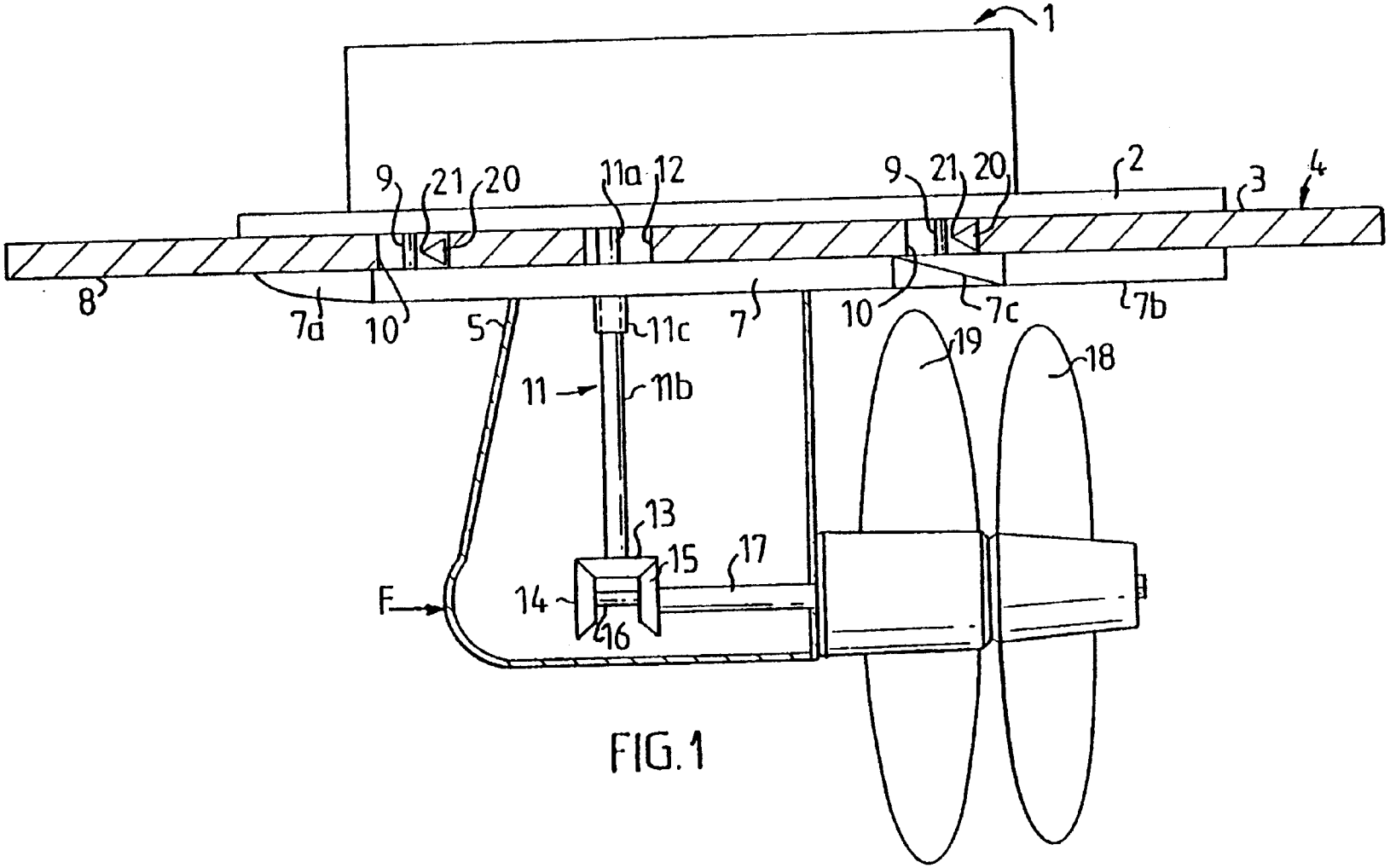
FIGS. 1 and 2 show diagrammatic side views of two embodiments of a drive assembly according to the invention.

In the figures, 1 generally designates a drive unit consisting of an engine with a reversing-gear mechanism which is fixed on a seating 2 which rests against an inner surface 3 on the bottom 4 of a boat. An underwater housing 5 is fixed against a plate 7 which is pressed against an outer surface 8 on the bottom 4. In front of the plate 7, a streamlined body 7*a* adjoining the plate 7 is fixed against the bottom 4. A sloping plane 7*c* is fixed in a gap between the rear edge of the plate 7 and a plate 7*b*. The seating 2 and the plate 7 are interconnected and clamped against the respective surfaces 3 and 8 by means of screws 9 which extend with play through openings 10 in the bottom 4. A vertical drive shaft 11 extends through an opening 12 in the bottom 4 into the housing 5 and, via a bevel gear 13 and two bevel gears 14 and 15, drives a pair of propeller shafts 16 and 17, of which the shaft 17 is a hollow shaft through which the shaft 16 extends. The shaft 16 bears a propeller 18 and the shaft 17 a propeller 19.

Cutting elements 20, which have cutting edges 21 facing towards the shanks of the screws 9, are fixed in the openings 10 in the bottom 4 of the boat. If, in the event of grounding, the housing 5 is exposed to an impact with a force F, which overcomes by a predetermined margin the frictional force between the seating 2 and the surface 3 and also between the plate 7 and the surface 8, the entire drive assembly 1 and 5 including the seating 2 and the plate 7 will be displaced and the cutting edges 21 of the cutting elements 20 will penetrate the screws 9 and shear these off, so that the housing 5 with the plate 7 is separated from the bottom of the boat. Sealing members (not shown), which close the openings 10 and 12 and prevent water penetration when the plate 7 is removed, can be arranged in the openings 10 and 12. The force F required in order to detach the housing 5 is defined on the one hand by the frictional force between the seating 2 and the plate 7 respectively and the bottom 4, which in turn depends on the clamping force of the screws 9, and on the other hand the additional force necessary in order to shear off the screws, This force is defined by the dimensions and material of the screws and can also be influenced by virtue of the screws being designed with break indications. The drive shaft 11 is divided into two parts 11*a*, 11*b* which are interconnected by means of a splined joint 11*c*, so that the lower part 11*b* can easily be detached from the upper part 11*a* when the separation takes place. The sloping plane 7*c* imparts to the plate 7 with the housing 5 a downwardly and rearwardly inclined movement in order to ensure that the shaft 11*b* is drawn out of the sleeve of the splined joint 11*c*.

Comparative tests carried out using two identical 36 foot planing motor boats with twin engines, one of which had drive assemblies with straight propeller shafts with one propeller on each shaft and the other of which had drive assemblies according to the invention with twin counter-rotating propellers, revealed significant improvements for the latter. The top speed increased by 10% at the same time as the fuel consumption at top speed was reduced by 10%. At a speed of 25 knots, the fuel consumption was as much as 15% lower in the boat with the drive assemblies according to the invention.

Figure 2:
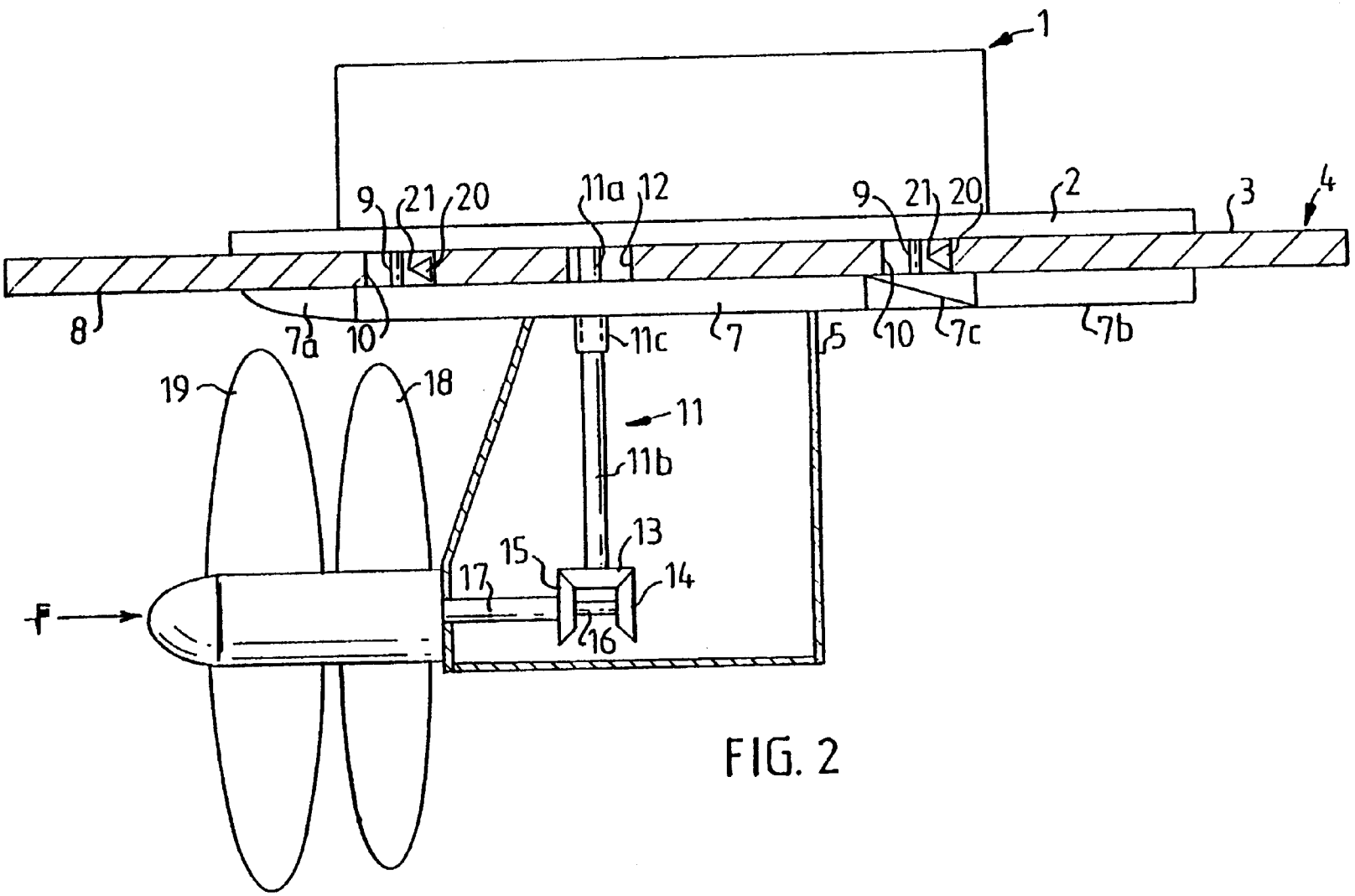

FIG. 2 shows a drive assembly which differs from the drive assembly in FIG. 1 only in that it has pulling instead of pushing propellers. In particular with regard to drives with pushing propeller(s), it can be an advantage to connect the drive rigidly directly to the flat of the stern of the boat instead of to its bottom.

What is claimed is:

1. Drive assembly in a boat, comprising a propeller drive which is arranged on the outside of a boat hull and has an at least essentially vertical drive shaft which, via an angle gear enclosed in an underwater housing, drives at least one substantially horizontal propeller shaft, and a drive unit which is arranged on the inside of the hull and to which the vertical drive shaft is drivably connected, the drive being connected to the hull of the boat via connecting members which, in the event of a given load acting on the underwater housing in the direction of the propeller shaft, are arranged so as to break in order to completely separate the underwater housing from the drive unit and the hull of the boat.

2. The drive assembly according to claim 1, wherein the vertical drive shaft is connected to the propeller shaft via a drive connection which comprises a joint which allows movement of the underwater housing in the axial direction of the vertical drive shaft.

3. The drive assembly according to claim 2, wherein the boat has a bottom having openings through which the connecting members extend; said openings containing cutting members which are arranged so as to cut off the connecting members in the event of a given displacement of the underwater housing in the direction of the propeller shaft.

4. The drive assembly according to claim 3, wherein two concentric propeller shafts driven in a counter-rotating manner are mounted in the underwater housing and each bears their own propeller.

5. The drive assembly according to claim 2, wherein two concentric propeller shafts driven in a counter-rotating manner are mounted in the underwater housing and each bears their own propeller.

6. The drive assembly according to claim 1, wherein two concentric propeller shafts driven in a counter-rotating manner are mounted in the underwater housing and each bears their own propeller.

7. The drive assembly according to claim 6, wherein the propellers are arranged on that side of the housing facing astern.

8. The drive assembly according to claim 6, wherein the propellers are arranged on that side of the housing facing ahead.

* * * * *